US009174079B2

(12) United States Patent
Berger et al.

(10) Patent No.: US 9,174,079 B2
(45) Date of Patent: Nov. 3, 2015

(54) MUSCLE STIMULATION DEVICE

(75) Inventors: Marc Berger, Oberstdorf (DE); Thomas Berger, Oberstdorf (DE)

(73) Assignee: tremo-tec GmbH, Oberstdorf (DE)

( * ) Notice: Subject to any disclaimer, the term of this patent is extended or adjusted under 35 U.S.C. 154(b) by 1334 days.

(21) Appl. No.: 12/086,910

(22) PCT Filed: Nov. 25, 2006

(86) PCT No.: PCT/EP2006/011316

§ 371 (c)(1),
(2), (4) Date: Oct. 9, 2008

(87) PCT Pub. No.: WO2007/079823

PCT Pub. Date: Jul. 19, 2007

(65) Prior Publication Data

US 2009/0177126 A1 Jul. 9, 2009

(30) Foreign Application Priority Data

Dec. 23, 2005 (DE) ..... 10 2005 062 432

(51) Int. Cl.

| | |
|---|---|
| ***A61H 1/00*** | (2006.01) |
| ***A63B 21/072*** | (2006.01) |
| ***A63B 21/00*** | (2006.01) |

(52) U.S. Cl.

CPC ..... *A63B 21/072* (2013.01); *A61H 1/00* (2013.01); *A63B 21/00196* (2013.01); *A63B 21/1434* (2013.01)

(58) Field of Classification Search

CPC .. A61H 1/00; A63B 21/072; A63B 21/00196; A63B 21/1434

USPC ..... 601/46, 49, 67, 69, 70, 71, 72, 73, 80, 601/81, 82, 84; 482/1, 5, 6, 7, 92, 93, 108, 482/109, 110

See application file for complete search history.

(56) References Cited

U.S. PATENT DOCUMENTS

| | | | | |
|---|---|---|---|---|
| 850,938 | A | 4/1907 | Kellogg | |
| 3,115,139 | A * | 12/1963 | Schneider | 601/70 |
| 4,878,489 | A * | 11/1989 | Kamayachi | 601/72 |
| 5,180,352 | A | 1/1993 | Sreter | |
| 5,868,653 | A | 2/1999 | Klasen | |
| 6,682,496 | B1 | 1/2004 | Pivaroff | |
| 2003/0009116 | A1 * | 1/2003 | Luettgen et al. | 601/46 |
| 2003/0083599 | A1 | 5/2003 | Kitov | |

FOREIGN PATENT DOCUMENTS

| | | | |
|---|---|---|---|
| DE | 9200725.2 | U1 | 4/1992 |
| DE | 10241340 | A1 | 3/2004 |
| SU | 1623671 | A1 | 1/1991 |

* cited by examiner

*Primary Examiner* — Quang D Thanh

(74) *Attorney, Agent, or Firm* — Muncy, Geissler, Olds & Lowe, P.C.

(57) ABSTRACT

The invention relates to a muscle stimulation device comprising a handle bar with a first and a second end, a motor which is arranged in a cavity in the handle bar and is coupled by means of a motor shaft to at least one eccentric body in order to set the muscle stimulation device vibrating by an unbalance of the eccentric body. According to the invention the eccentric body/ies has/have a common center of mass, which is at a different distance from the first end of the handle bar than it is from the second end of the handle bar. The invention furthermore relates to an exchangeable head for such a muscle stimulation device.

26 Claims, 5 Drawing Sheets

Fig. 1
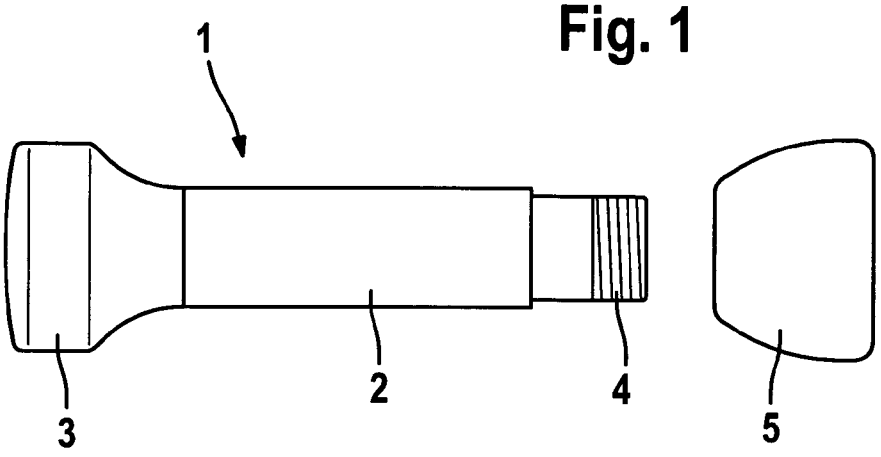
Fig. 3
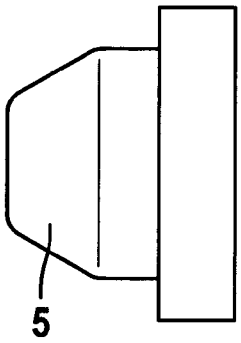
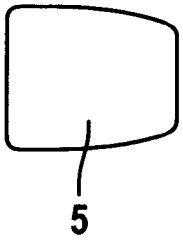
Fig. 4
Fig. 5
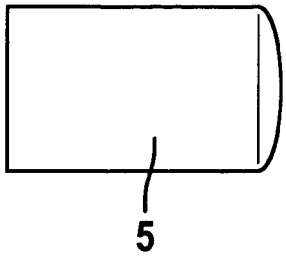

Fig. 7
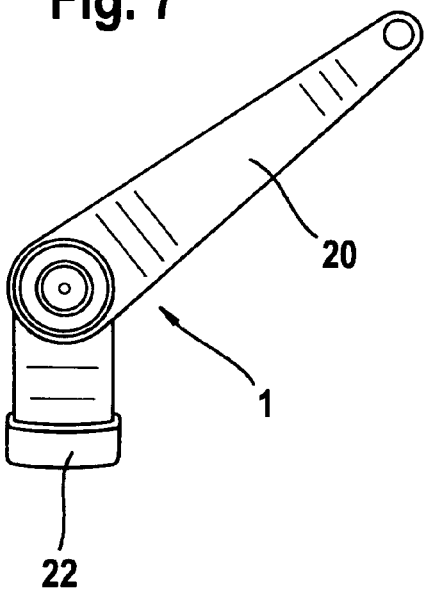
Fig. 6
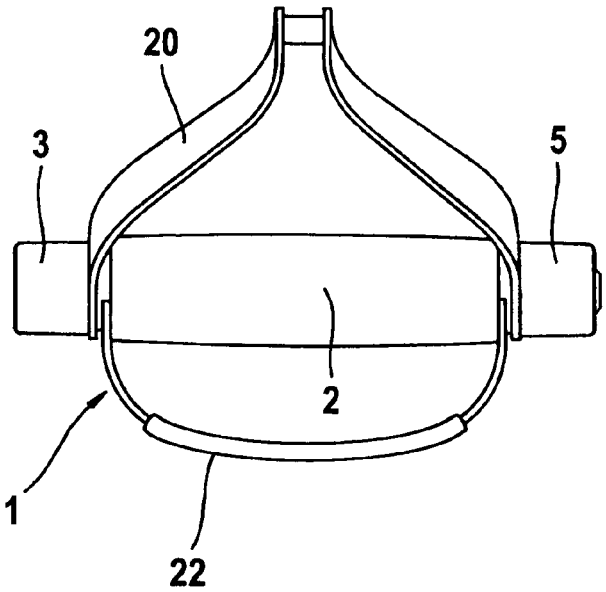
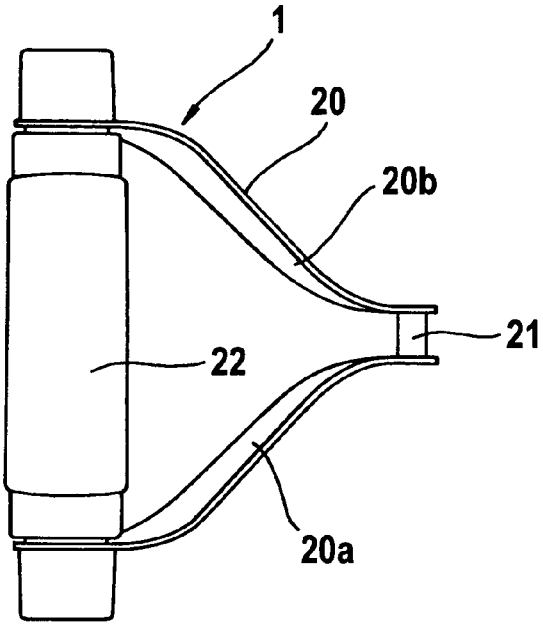
Fig. 8
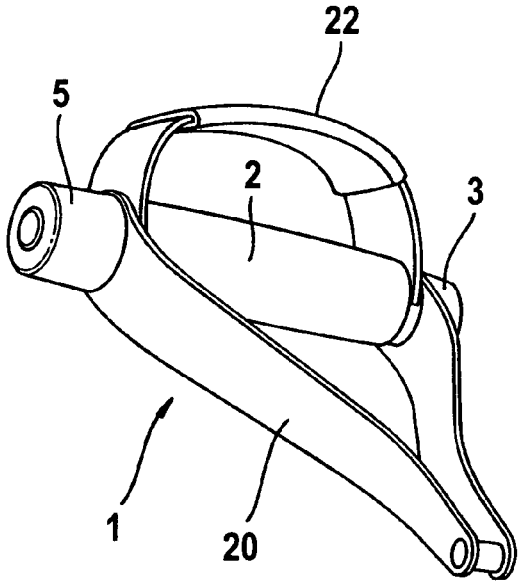
Fig. 9

MUSCLE STIMULATION DEVICE

The invention relates to a muscle stimulation device comprising a handle bar with a first and a second end, as well as a motor which is arranged in a cavity of the handle bar and is coupled by means of a motor shaft to at least one eccentric body in order to set the muscle stimulation device vibrating by an unbalance of the eccentric body.

A dumbbell with a vibrating bar is known from DE 195 32 254 C1, in which there are a motor and two eccentric bodies arranged symmetrically in relation to the ends of the dumbbell bar. By rotating the eccentric bodies, the dumbbell bar is set vibrating, wherein disc-shaped weights attached to the dumbbell bar are decoupled from the vibration of the dumbbell bar by an interlayer of vibration absorbers. During training with this kind of dumbbell, vibrations of the dumbbell bar transfer onto muscle parts being used, and stimulate nerves coordinating motions. This leads to a faster building up of muscles than in training with conventional dumbbells and counteracts the occurrence of cramp.

The dumbbell known from DE 195 32 254 C1 is well suited as a training device for an accelerated building up of the biceps and triceps muscles, however, it offers no further possibilities for use or training.

The object of the invention is to create a muscle stimulation device with broader possibilities for use as a training and therapeutic device.

SUMMARY OF THE INVENTION

This object is solved according to the invention with a muscle stimulation device of the type cited at the beginning in that the eccentric body/ies has/have a common center of mass which has a different distance from the first end of the handle bar than it does from the second end of the handle bar. This can be most easily achieved if only a single eccentric body is used, which is arranged in the cavity near to one end of the handle bar.

In the dumbbell known from DE 195 32 254 C1, the center of mass of both eccentric bodies is located in the middle between the two ends of the dumbbell bar, so that the dumbbell bar is symmetrically set in vibration. In a muscle stimulation device according to the invention, the center of mass of the eccentric body/ies (i.e. of the common center of mass of the eccentric bodies) is displaced towards one end of the handle bar, so that the vibrations produced in operation on the two ends of the handle bar are of differing strength. In a muscle stimulation device according to the invention, the vibrations generated can therefore be concentrated on one end of the handle bar and hence on one head attached to the corresponding end of the handle bar. In this way, the muscle stimulation device can serve not only like a dumbbell as a training device, but also as a therapeutic or massage device, with which vibrations can be transferred to a part of the body against which the corresponding end of the muscle stimulation device or a massage head affixed to it is pressed.

Due to its pleasant and highly effective vibrations, a muscle stimulation device according to the invention lends itself particularly to use within the scope of physiotherapy and physical neuromuscular stimulation, for example for training uses, for prevention or massage as well as for veterinary and medical uses and for rehabilitation.

Exchangeable heads for a muscle stimulation device according to the invention can be optimized for specific uses, for example in that the weight, size, surface condition, elasticity and connection to the vibrations of the handle bar are adjusted to requirements of a given usage. The invention therefore also relates to an exchangeable head for a muscle stimulation device according to the invention. A further aspect of the invention, which also has independent relevance, relates to a muscle stimulation device comprising a handle bar with a first and a second end, a motor, which is arranged in a cavity of the handle bar and is coupled to an eccentric body by means of a motor shaft in order to set the muscle stimulation device vibrating by an unbalance of the eccentric body, wherein a massage head, which is set in vibration by the unbalance of the eccentric body, is affixed to the handle bar.

BRIEF DESCRIPTION OF THE DRAWINGS

Further details and advantages of the invention are described on the basis of an exemplary embodiment, taking into account the attached drawings. The features of the exemplary embodiment can be used individually or in combination in order to create preferred embodiments of the invention. In the figures:

FIG. 1 shows an exemplary embodiment of a stimulation device according to the invention, in side view, with an associated exchangeable head;

FIG. 3 shows a further exemplary embodiment of an exchangeable head for the muscle stimulation device depicted in FIG. 1;

FIG. 4 shows a further exemplary embodiment of an exchangeable head for the muscle stimulation device depicted in FIG. 1;

FIG. 5 shows a further exemplary embodiment of an exchangeable head for the muscle stimulation device depicted in FIG. 1;

FIG. 6 shows a further exemplary embodiment of a muscle stimulation device according to the invention with a clamp for affixing it to a training device;

FIG. 7 shows the exemplary embodiment shown in FIG. 6, in side view;

FIG. 8 shows the exemplary embodiment shown in FIG. 6, in another side view; and FIG. 9 shows the exemplary embodiment shown in FIG. 6, in an oblique view.

DETAILED DESCRIPTION

Figure 2:
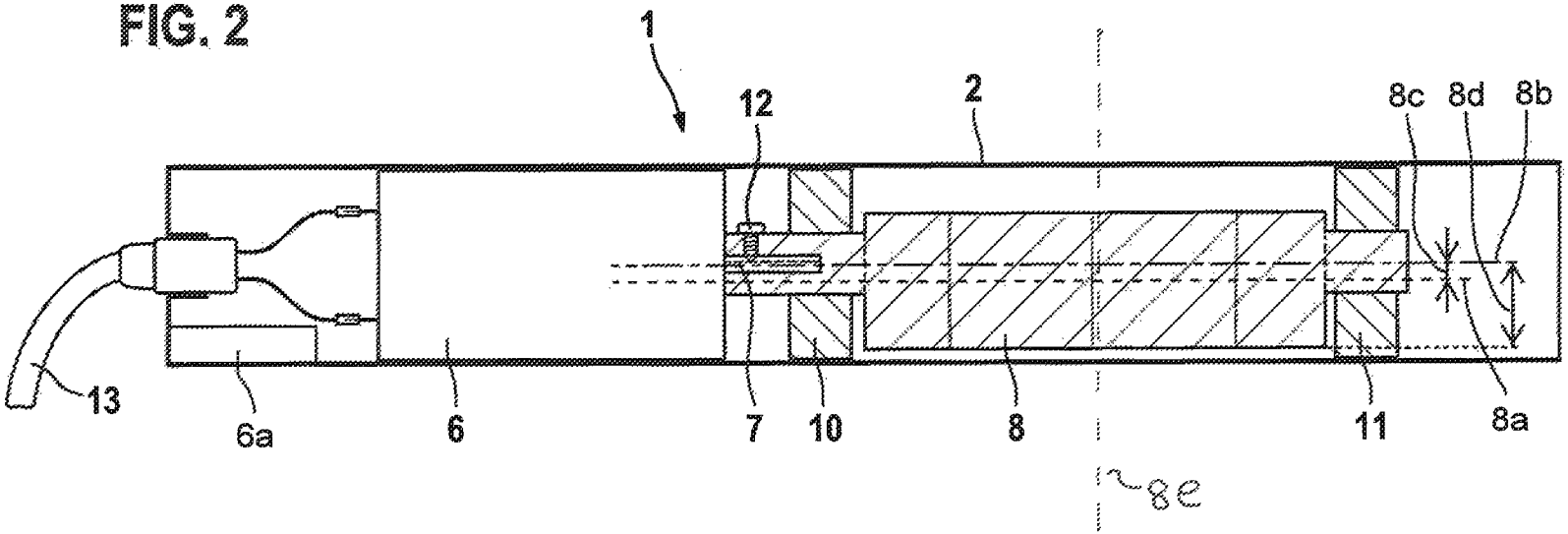
FIG. 2 shows a partial view of the exemplary embodiment depicted in FIG. 1 in a schematic longitudinal section view.
Figure 10:
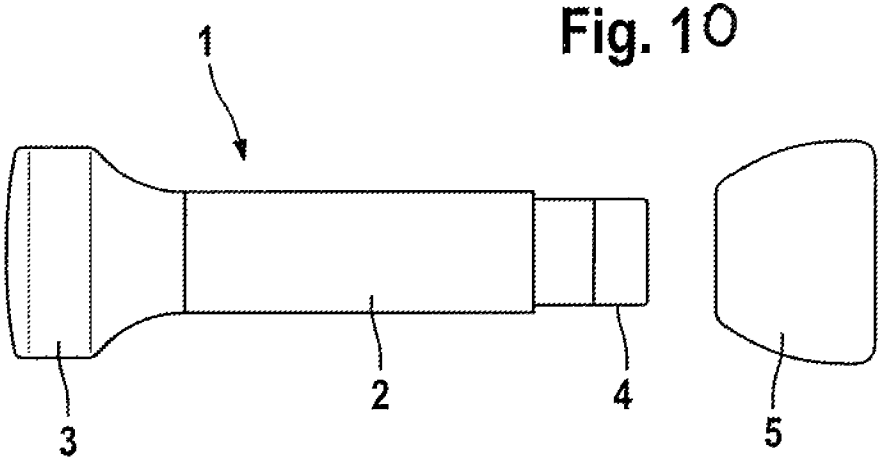
FIG. 10 shows an alternative embodiment showing a plug connection between the heat and the handle bar.
Figure 11:
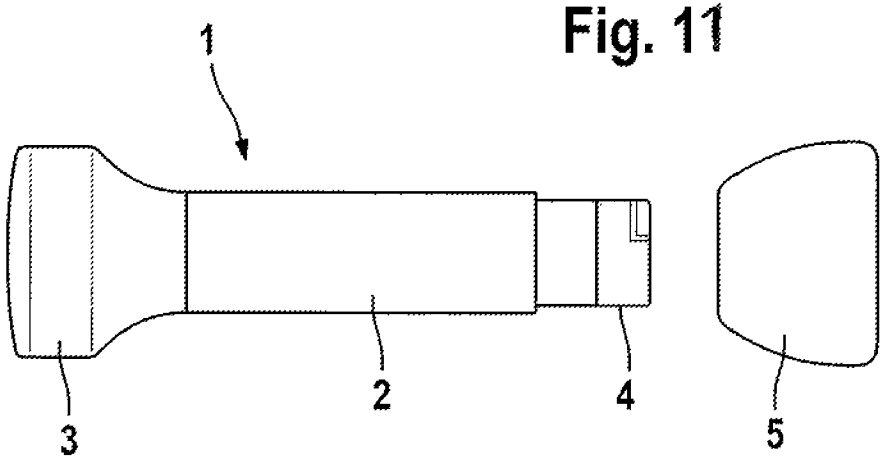
FIG. 11 shows another alternative embodiment with a bayonet connection between the head and the handle bar.

The muscle stimulation device 1 depicted in FIG. 1 comprises a handle bar 2, onto the first end of which a head 3 is affixed by material connection. On the second end of the handle bar 2 there is a connecting element 4 to affix an exchangeable head 5. In the exemplary embodiment depicted, the connecting element 4 is designed as an external thread which, together with an appropriate counterpart of the exchangeable head 5, forms a screw connection. Alternatively, with an appropriate counterpart of an exchangeable head 5, the connecting element 4 can, however, also form a plug connection or a bayonet joint, in particular a bayonet lock, and be formed correspondingly.

In FIG. 2, a section of the handle bar 2 of the muscle stimulation device 1 is depicted in a schematic longitudinal section view. The handle bar 2 designed as a tube contains a cavity in which a motor 6 is arranged which is coupled to an eccentric body 8 by means of a motor shaft 7, in order to set the muscle stimulation device 1 and an exchangeable head 5 attached to it in vibration by an unbalance of the eccentric body 8. The eccentric body 8 is located between the motor 6 and the second end of the handle bar 2, on which there is an exchangeable head according to the intended use. The center of mass of the eccentric body 8 therefore is at a different distance from the first end of the handle bar 2 as it does from the second end of the handle bar 2.

Preferably, only a single eccentric body 8 is arranged in the handle bar 2, however, in principle, several eccentric bodies 8 can be arranged in the handle bar 2. Preferably, in such a case the common center of mass 8*e* of all eccentric bodies is at a different distance from the first end of the handle bar 2 as from the second end of the handle bar 2. In this way the vibrations generated by rotation of the eccentric body/ies 8 can be concentrated on the second end of the handle bar 2, onto which an exchangeable head 5 can be attached.

A massage head or a counterweight to the fixed head 3 can be affixed to the handle bar 2 as an exchangeable head 5. The muscle stimulation device can be used like a dumbbell as a training device or with a massage head as a massage device depending on the type of exchangeable head 5 used. In this way, an improved training or therapeutic effect can be achieved by pleasant vibrations.

Preferably, the distance between the center of mass of the eccentric body/ies 8 and the first end of the handle bar 2 differs from the distance between the center of mass of the eccentric body/ies 8 and the second end of the handle bar 2 by at least 20%, preferably at least 40%, particularly preferably at least 75%, in particular at least 100%. In the exemplary embodiment depicted in FIGS. 1 and 2, the center of mass of the eccentric body 8 is twice as far away from the first end of the handle bar 2 as from the second end of the handle bar 2.

In order that the vibrations generated can be transferred onto an exchangeable head 5 as well as possible, it is beneficial to use a eccentric body 8 with a length which is greater than the diameter of the handle bar 2, preferably at least twice as large. It is particularly beneficial to choose the length of the eccentric body 8 or the total length of the eccentric bodies 8 so that this comes to at least 10%, preferably 15% to 50%, particularly preferably 20% to 40%, in particular 25% to 35% of the length of the handle bar 2. FIG. 2 also shows the battery case 6*a* within the handle bar 2. The axis of inertia 8*a*, the geometric rotation axis 8*b*, the distance 8*c* of the axis of inertia 8*a* from the geometric rotation axis 8*b*, and the radius 8*d* of the circular area swapped over during the rotation of the eccentric body 8 around the geometric rotation axis 8*b* of the eccentric body 8 are also shown in FIG. 2.

A bracket 10 is arranged between the motor 6 and the eccentric body 8, by which an unbalance moment generated by the eccentric body 8 is transferred onto the handle bar 2. In a corresponding manner, a bracket 11 is arranged on the side of the eccentric body 8 facing away from the motor 6, by which an unbalance moment generated by the eccentric body 8 is transferred onto the handle bar 2. The coupling of the motor shaft 7 with the eccentric body 8 is secured by means of a screw 12, for example a grub screw.

The motor 6 in question is an electromotor which can be connected to a power supply through the first end of the handle bar 2. To this end, a power cable 13 is fed through a front face of the head 3, or the first end of the handle bar 2. Instead of a cable feedthrough, a connecting socket can also be placed in the head 3, into which a power cable 13 plug can be inserted. A beneficial place for such a connecting socket is the front face of the head 3. It is particularly beneficial to arrange a battery case 6*a* for receiving one or several batteries to supply power to the electromotor 6 in the cavity of the handle bar 2, which is preferably a tube. Rechargeable accumulators, which can always be recharged again through a power cable 13, can be inserted into such a battery case.

In operation, the electromotor 6 has a rotational speed of less than 100 rotations per second, preferably between 20 and 80 rotations per second. It is particularly beneficial to equip the muscle stimulation device 1 with a controller (not shown) which enables setting of the rotational speed and thereby the vibration frequency in the physiologically advantageous range below 100 Hz.

Exemplary embodiments of various exchangeable heads which could be affixed to the second end of the handle bar 2 are depicted in FIGS. 3 to 5. Each of these exchangeable heads 5 thereby features a counterpart (not shown) appropriate to the connecting element 4 of the handle bar. The amplitude of the vibrations generated in the handle bar 2 can be influenced by size and weight of the exchangeable heads 5, so that optimal conditions can be generated for the particular intended usage. The exchangeable heads can thereby correspond in shape and weight to the fixed head 3, so that the muscle stimulation device can be used as a dumbbell with vibrating dumbbell bar, in order to be able to use a training effect which is improved in comparison with conventional dumbbells. The exchangeable heads 5 can, however, be chosen so as to be divergent from the fixed head 3 as regards weight, shape and material, so that they can be used in particular as massage heads which are vibratingly coupled to the handle bar 2. Particularly pleasant are massage heads 5 with a wooden or plastic surface, in particular with bobbles.

Vibrations with a muscle stimulation device can be particularly efficiently and physiologically advantageously generated when the distance of the axis of inertia of the eccentric body/ies 8 from the geometric rotational axis of the eccentric body/ies comes to between 30% and 80% of the radius of the circular area, which is swept over in operation by the eccentric body/ies 8. This circular area is somewhat smaller than the inner diameter of the cavity in the handle bar 2. The distance between the axis of inertia mentioned and the geometric rotational axis of the eccentric body 8 preferably comes to between 35% and 70%, particularly preferably between 40% and 60%, in particular between 40% and 50% of the radius of the circular area mentioned. The eccentric bodies 8 are preferably cylindrical, so that their axis of inertia is consistent with their geometric longitudinal axis.

In FIGS. 6 to 9 a further exemplary embodiment of a muscle stimulation device 1 is depicted, which essentially differs from the preceding exemplary embodiment by a clamp 20 for affixing it to a training device. For example, two of this kind of muscle stimulation device 1 can be used for an expander, in that they are affixed by their clamps 20 to a rubber or elastic band. Furthermore, the muscle stimulation device 1 can be affixed with the clamp 20 to pulling devices are other training devices so that the pleasant vibrations of the handle bar 2 can also be used in training of muscle parts which are not strained in dumbbell training.

The clamp 20 has a cylindrical connecting pin 21 which connects the two halves of the clamp 20*a* and 20*b* and onto which the karabiner hook of a training device can be hooked, for example.

So that the clamp 20 can be easily affixed onto the handle bar 2 and removed again, exchangeable heads 5 can be used in the exemplary embodiment depicted on both ends of the handle bar 2. However, a head which is durably affixed to the handle bar 2, in particular with material connection, will preferably also be used in combination with an exchangeable head 5 also in the exemplary embodiment depicted in FIGS. 6 to 9. For example, the clamp 20 can feature two openings, through which the handle bar 2 can be pushed when the exchangeable head 5 has been detached. The clamp 20 is locked in use by the fixed head 3 and the exchangeable head 5. In this way, the clamp 20, just like the exchangeable head 5, can be easily attached to the handle bar 2 by a user, and removed again.

In addition to the clamp 20, a handle or hand guard 22, as shown in FIGS. 6, 7 and 9, can also be affixed to the handle bar 2 in the same manner.

LIST OF REFERENCE NUMERALS

1 muscle stimulation device
2 handle bar
3 head on the first end of the handle bar
4 connecting element
5 exchangeable head
6 motor
7 motor shaft
8 eccentric body
10 bracket
11 bracket
12 screw
13 power cable
20 clamp
20*a* half of clamp
20*b* half of clamp
21 connecting point
22 hand guard

What is claimed is:

1. A muscle stimulation device comprising:
a handle bar with a first end and a second end;
at least one eccentric body arranged in the handle bar;
a motor shaft extending through the at least one eccentric body such that an axis of the motor shaft is offset with respect to an axis of the eccentric body, the axis of the motor shaft and the axis of the at least one eccentric body extending parallel to one another; and
a motor arranged in the handle bar, the motor being coupled via the motor shaft to the at least one eccentric body in order to vibrate the muscle stimulation device upon a rotation of the eccentric body,
wherein the motor is arranged between the first end of the handle bar and the at least one eccentric body, and
wherein the at least one eccentric body is arranged only between the second end of the handle bar and the motor, and
wherein there is no eccentric body attached to a motor shaft that is arranged between the motor and the first end of the handle bar,
wherein a common center of a total mass of all eccentric bodies arranged in the handle bar is at a different distance from the first end of the handle bar than it is from the second end of the handle bar such that the total mass of the eccentric bodies is not symmetric with a center of the muscle stimulation device.

2. The muscle stimulation device of claim 1, said handle bar further having a cavity formed therein, wherein the motor is positioned in said cavity of said handle bar.

3. The muscle stimulation device of claim 1, further comprising: a head affixed to said first end of said handle bar.

4. The muscle stimulation device of claim 1, said handle bar having a connecting element at said second end thereof, said connecting element suitable for affixing an exchangeable head thereto.

5. The muscle stimulation device of claim 4, said exchangeable head being a corresponding connecting element affixed to said connecting element of said handle bar.

6. The muscle stimulation device of claim 5, said exchangeable head being a massage head suitable for transferring vibrating of said handle bar to another surface.

7. The muscle stimulation device of claim 4, said connecting element being a plug connection.

8. The muscle stimulation device of claim 4, said connecting element being a bayonet lock.

9. The muscle stimulation device of claim 4, said connecting element being a screw connection.

10. The muscle stimulation device of claim 1, said first end of said handle bar having a power cable extending therefrom, said power cable suitable for connection to a power source.

11. The muscle stimulation device of claim 1, said first end of said handle bar having a plug connection formed thereat, said plug connection suitable for connection to a power cable.

12. The muscle stimulation device of claim 1, further comprising: a power source connected to a face at said first end of said handle bar.

13. The muscle stimulation device of claim 1, further comprising: a battery case; and a battery received in said battery case, said battery being in electrical connection to said motor.

14. The muscle stimulation device of claim 1, wherein the distance of said common center of the total mass of all of the eccentric bodies from said first end of said handle bar differs by at least 20% from said second end of said handle bar.

15. The muscle stimulation device of claim 14, wherein the distance of said common center of the total mass of all of the eccentric bodies from said first end of said handle bar differs by at least 40% from said second end of said handle bar.

16. The muscle stimulation device of claim 14, wherein the distance of said common center of the total mass of all of the eccentric bodies from said first end of said handle bar differs by at least 75% from said second end of said handle bar.

17. The muscle stimulation device of claim 14, wherein the distance of said common center of the total mass of all of the eccentric bodies from said first end of said handle bar differs by at least 100% from said second end of said handle bar.

18. The muscle stimulation device of claim 1, wherein the distance of the common center of the total mass of all of the eccentric bodies is closer to said second end of said handle bar than said first end of said handle bar.

19. The muscle stimulation device of claim 1, wherein the at least one eccentric body is positioned on a side of said motor facing said second end of said handle bar.

20. The muscle stimulation device of claim 1, further comprising: a bracket arranged between said motor and the eccentric body, said bracket transferring vibrations to said handle bar.

21. The muscle stimulation device of claim 1, further comprising: a bracket arranged on a side of the at least one eccentric body facing away from said motor, said bracket transferring vibrations to said handle bar.

22. The muscle stimulation device according to claim 1, wherein the at least one eccentric body is arranged between a first bracket and a second bracket, the first bracket and the second bracket fixedly supporting the motor shaft within a cavity of the handle bar.

23. The muscle stimulation device according to claim 22, wherein the first bracket is arranged between the motor and the at least one eccentric body.

24. The muscle stimulation device according to claim 1, wherein the motor shaft extends through the eccentric body such that a rotational axis of the motor shaft is offset with respect to a longitudinal center axis of the eccentric body, and wherein the axis of the motor shaft and the axis of the eccentric body extend parallel to one another.

25. The muscles stimulation device according to claim 1, wherein the motor is arranged within a cavity of the handle bar only between the first end of the handle bar and the at least one eccentric body.

26. The muscle stimulation device according to claim 1, wherein a plurality of eccentric bodies are arranged only between the second end of the handle bar and the motor.

* * * * *